United States Patent [19]

Shankar

[11] Patent Number: 4,501,776

[45] Date of Patent: Feb. 26, 1985

[54] METHODS OF FORMING A PROTECTIVE DIFFUSION LAYER ON NICKEL, COBALT AND IRON BASE ALLOYS

[75] Inventor: Srinivasan Shankar, Branford, Conn.

[73] Assignee: Turbine Components Corporation, Brandford, Conn.

[21] Appl. No.: 437,952

[22] Filed: Nov. 1, 1982

[51] Int. Cl.[3] ..... C23C 11/00

[52] U.S. Cl. ..... 427/253; 427/250

[58] Field of Search ..... 427/253, 252, 237, 250

[56] References Cited

U.S. PATENT DOCUMENTS 3,677,789 7/1972 Bungardt et al. ..... 427/205

4,132,816 1/1979 Benden et al. ..... 427/253 X

*Primary Examiner*—Sam Silverberg

*Attorney, Agent, or Firm*—Buell, Ziesenheim, Beck & Alstadt

[57] ABSTRACT

Methods are provided for forming protective diffusion layers on nickel, cobalt and iron base alloy parts comprising the steps of depositing a coating of a platinum group metal on the surface of the part to be protected and forming a diffusion layer of platinum and aluminum on said surfaces by gas phase aluminizing said surfaces out of contact with a source of gaseous aluminizing species at elevated temperature.

15 Claims, 3 Drawing Figures

$PtAl_2$ + β NiAl

β NiAl

Diffusion Zone $PtAl_2$ + β NiAl

β NiAl

Diffusion Zone

METHODS OF FORMING A PROTECTIVE DIFFUSION LAYER ON NICKEL, COBALT AND IRON BASE ALLOYS

This invention relates to methods of forming a protective diffusion layer on nickel, cobalt and iron base alloys and particularly to a method of forming a diffusion layer of combined platinum and aluminum or nickel, cobalt and iron base alloys.

It has long been known to apply a diffusion layer of aluminum in nickel, cobalt and iron base alloy parts by pack cementation processes which involve packing such parts in a bed of powdered mixture consisting of a source of aluminum and an inert filler material and heated to elevated temperature (e.g. 1400°-2000° F.) for several hours to diffuse aluminum into the surfaces of the alloy parts being treated.

It has also been proposed to improve the oxidation and corrosion resistance of such articles by first coating the alloy part with a platinum group metal by electrodeposition or other means and then to aluminize the platinum plated part by pack cementation. Such a process is taught in Bungardt et al. U.S. Pat. No. 3,677,789.

It has been proposed also in Benden et al. U.S. Pat. No. 4,148,275 to diffusion aluminize hollow tubes or the like by connecting the hollow portions to a manifold and to force a carrier gas over a heated bed of a mixture of a source of aluminum and an inert filler and into the hollow portions to carry a portion of volatilized aluminum into the passages.

Such protective diffusion layers are particularly advantageous for gas turbine engine components and the like which are subject to high temperatures and oxidative and hot corrosive environments.

Many such parts are of relatively complex design having internal passages and the like which are not in contact with the source of aluminum and inert material used in pack cementation and which are not only not coated but may become clogged or obstructed with the powdered mixture during the pack cementation process and must be cleaned. Such parts may also have areas which are subjected to less corrosive environments and which therefore require less protective coating than others.

The present invention is designed in part to solve the problems of treating such articles which cannot be satisfactorily or economically treated by prior art processes and to permit coating only those portions which require coating.

This invention provides a method and product in which a platinum group metal coating is applied to those surfaces subject to the most extreme heat and oxidative and hot corrosive conditions, and thereafter the part is gas phase aluminized out of contact with a mixture of aluminum or aluminum alloy, an activator and an inert filler material at elevated temperature. Preferably the platinum group metal is platinum. The coated part may be heat treated at elevated temperatures in vacuum or inert atmosphere between about 1500° F. to 2000° F. for up to 10 hours before subjecting the same to gas phase aluminizing. Such heat treatment is preferably in the range of 1 to 5 hours, however, it may be omitted with some loss of effectiveness. Gas phase aluminizing is preferably carried out at temperatures in the range 1200° F. to 2100° F. for time periods of 1 to 20 hours depending upon the depth of diffusion layer desired. Preferably platinum coating of the part is by electroplating with the platinum plating thickness between about 0.0001 inch and 0.0007 inch. Preferably the gas phase aluminizing is carried out above a mixture of 1% to 35% of a source of aluminum, up to 40% activator (usually a halide) and the balance inert filler. Preferably the total combined diffusion layer of platinum and aluminum is about 0.0005 to 0.004 inches (0.5 mil to 4 mil) thick.

In the foregoing general description of this invention certain objects, purposes and advantages have been set out. Other objects, purposes and advantages of this invention will be apparent from a consideration of the following description and the drawings in which.

Figure 1:
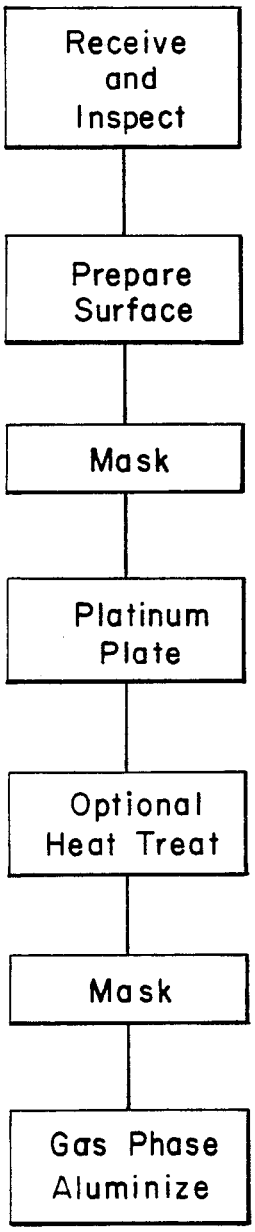
FIG. 1 is a flow diagram of the preferred steps of this invention.

The flow diagram of FIG. 1 illustrates the preferred process steps of this invention; namely inspect, prepare (degrease, blast, rinse), mask areas not to be plated, plate with platinum, optionally heat treat to diffuse the platinum, mask areas not to be coated, and gas phase aluminize.

Figure 2:
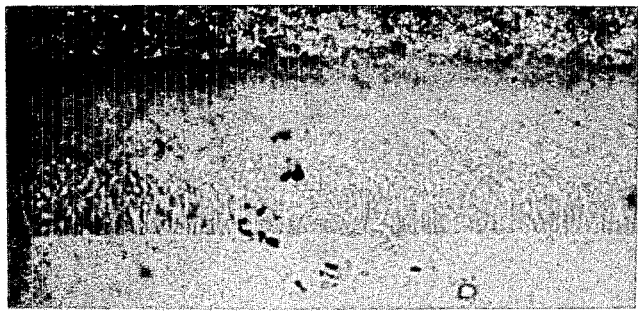
FIG. 2 is a micrograph of a diffusion coating of platinum and aluminum fabricated according to the practice set out in FIG. 1.
Figure 3:
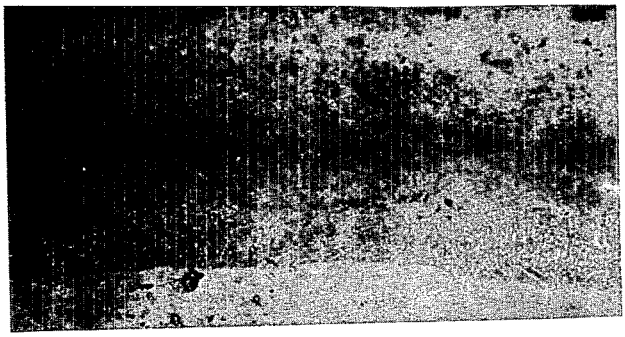
FIG. 3 is a diffusion coating in which aluminum diffusion was carried out by pack cementation.

The practice will be better understood by reference to the following example. A turbine blade having cooling passages was inspected, degreased, blast cleaned and electroplated on critical surfaces with platinum to a thickness of 0.0003 inches. The plated turbine blade was heat treated at about 1900° F. for 3 hours in argon atmosphere to diffuse the platinum into the surfaces. The blade was then suspended above and out of contact with a source of gaseous aluminizing species, heated to about 2000° F. for 5 hours with a circulating argon carrier gas moving around the blade and through the passages therein carrying gaseous aluminizing species which effect desposition and diffusion of aluminum into the blade surfaces. The final surface section is illustrated in FIG. 2.

The parts treated according to this invention are much more resistant to oxidation and hot corrosion than like parts aluminized by pack cementation as in U.S. Pat. No. 3,677,789. The complex internal passages in the blades treated according to this invention have a protective aluminum coating whereas parts treated by pack cementation have passages which are not aluminized.

This invention can be applied to newly manufactured parts or to remanufactured or rehabilitated parts with equal satisfaction.

In the foregoing specification certain preferred practices and embodiments of this invention have been set out, however, it will be understood that this invention may be otherwise embodied within the scope of the following claims.

I claim:

1. A method for forming a protective diffusion layer on selected areas of nickel, cobalt and iron base alloy parts comprising the steps of depositing a coating of a platinum group metal on the surface of the part to be protected and forming a diffusion layer of platinum and aluminum on said surfaces by gas phase aluminizing said surfaces out of contact with a source of aluminizing gaseous species at elevated temperature.

2. The method of claim 1 wherein the platinum group metal is platinum.

3. The method of claim 1 wherein the platinum group metal coating is applied by one of electroplating, dipping, spraying, vapor deposition, sputtering and mechanical plating.

4. A method as claimed in claim 2 wherein the platinum coating is applied by one of electroplating, dipping, spraying, vapor deposition, sputtering and mechanical plating.

5. A method as claimed in claim 1 wherein the gas phase aluminizing is carried out by holding the part at elevated temperature above and spaced from a mixture consisting of a source of aluminum, an activator and an inert filler.

6. A method as claimed in claim 2 wherein the gas phase aluminizing is carried out by holding the part at elevated temperature above and spaced from a mixture consisting of a source of aluminum, an activator and an inert filler.

7. A method as claimed in claim 4 wherein the gas phase aluminizing is carried out by holding the part at elevated temperature above and spaced from a mixture consisting of a source of aluminum, an activator and an inert filler.

8. A method as claimed in claim 1 wherein the part coated with platinum group metal is heated to diffuse the platinum into the surfaces of the part prior to gas phase aluminizing.

9. A method as claimed in claim 8 wherein the part is heated to a temperature between about 1500° F. and 2000° F. in one of a vacuum or inert atmosphere for one to five hours.

10. A method as claimed in claim 2 wherein the part coated with platinum group metal is heated to diffuse the platinum into the surfaces of the part prior to gas phase aluminizing.

11. A method as claimed in claim 10 wherein the part is heated to a temperature between about 1500° F. and 2000° F. in one of a vacuum or inert atmosphere for one to five hours.

12. A method as claimed in claim 1 wherein gas phase aluminizing is carried out at a temperature between about 1200° F. and 2100° F. in one of a vacuum, an inert atmosphere and a reducing atmosphere for one to twenty hours.

13. A method as claimed in claim 2 wherein gas phase aluminizing is carried out at a temperature between about 1200° F. and 2100° F. in one of a vacuum, an inert atmosphere and a reducing atmosphere for one to twenty hours.

14. A method as claimed in claim 5 wherein the mixture consists essentially of about 1 to 35% of one or more of the group consisting of aluminum and aluminum alloys, up to about 40% activator and the balance aluminum oxide filler.

15. A method as claimed in claim 6 wherein the mixture consists essentially of about 1 to 35% of one or more of the group consisting of aluminum and aluminum alloys, up to about 40% activator and the balance aluminum oxide filler.

* * * * *

UNITED STATES PATENT AND TRADEMARK OFFICE

CERTIFICATE OF CORRECTION

PATENT NO. : 4,501,776

DATED : February 26, 1985

INVENTOR(S) : SRINIVASAN SHANKAR

It is certified that error appears in the above-identified patent and that said Letters Patent is hereby corrected as shown below:

Column 1, line 9, change "or" to --on--.

Signed and Sealed this

*Eighth* Day of *October 1985*

[SEAL]

*Attest:*

DONALD J. QUIGG

*Attesting Officer*

*Commissioner of Patents and Trademarks—Designate*